US005845994A

United States Patent [19]

Rice

[11] Patent Number: 5,845,994

[45] Date of Patent: Dec. 8, 1998

[54] MESH BAG

[76] Inventor: Mark S. Rice, By Heavenly Treasures, P.O. Box 281, Silt, Colo. 81652

[21] Appl. No.: 802,257

[22] Filed: Feb. 19, 1997

Related U.S. Application Data

[60] Provisional application No. 60/017,288 May 13, 1996.

[51] Int. Cl.[6] ..... B65D 33/28

[52] U.S. Cl. ..... 383/76; 383/74; 383/117; 224/602

[58] Field of Search ..... 383/117, 71, 72, 383/74, 76; 224/600, 601, 602, 610

[56] References Cited

U.S. PATENT DOCUMENTS

| | | | |
|---|---|---|---|
| D. 161,954 | 2/1951 | Molinari | 383/117 X |
| D. 252,355 | 7/1979 | Uber . | |
| D. 288,744 | 3/1987 | Taylor . | |
| D. 365,204 | 12/1995 | Chen . | |
| 672,499 | 4/1901 | Tully . | |
| 735,560 | 8/1903 | Muller . | |
| 1,084,584 | 1/1914 | Moody | 383/117 X |
| 1,240,060 | 9/1917 | Kulick . | |
| 1,749,776 | 3/1930 | O'Lena . | |
| 2,253,688 | 8/1941 | Collins | 383/117 X |
| 2,510,186 | 6/1950 | Marisco et al. | 383/72 X |
| 3,322,176 | 5/1967 | Geller | 383/117 X |
| 3,483,907 | 12/1969 | Corridon | 383/76 |
| 4,932,790 | 6/1990 | Jorda | 383/74 |
| 5,031,759 | 7/1991 | Ogilvie . | |
| 5,135,222 | 8/1992 | Spector | 383/76 X |
| 5,207,725 | 5/1993 | Pinkerton . | |

FOREIGN PATENT DOCUMENTS

| | | | |
|---|---|---|---|
| 525464 | 5/1956 | Belgium | 383/76 |
| 1364048 | 5/1964 | France . | |
| 33 00 573 | 7/1983 | Germany . | |

*Primary Examiner*—Jes F. Pascua
*Attorney, Agent, or Firm*—Edwin H. Crabtree; Ramon L. Pizarro; Donald W. Margolis

[57] ABSTRACT

A holding device includes a mesh container having a closed end and an opposite open end defining an interior. A tassel may hang from the container proximate the closed end. The mesh container may be formed by a plurality of strands braided and tied together in a series of knots such that a diamond-shape weave appears. A drawstring is inserted through the interstices of the mesh at the open end of the container. A cinching mechanism, such as a draw bead, slidably engages the drawstring for opening and closing the open end of the container. The drawstring may have a connecting ring for enhancing safety.

15 Claims, 2 Drawing Sheets

MESH BAG

CROSS-REFERENCE TO RELATED APPLICATION

This application claims the benefit of U.S. Provisional Patent: application Ser. No. 60/017,288, filed May 13, 1996.

BACKGROUND OF THE INVENTION

1. Field of the Invention

The present invention relates to bags and more particularly to mesh bags having drawstring closures.

2. Description of Prior Art

Due to the inconvenience of carrying objects in one's hands, there has been a desire to create holding devices of all types, including pouches, packs, handbags, and bags for holding foodstuff is and other items. Oftentimes used as articles of clothing, pouches, packs, and handbags usually have solid walls. Solid walls generally retain water when wet, leading to an increase in weight which is uncomfortable for a user. Furthermore, such a construction usually leads to an increase in manufacturing costs.

Examples of the prior art relative to such holding devices include U.S. Pat. No. Des. 252,355 issued Jul. 10, 1979, to Robert N. Uber; U.S. Pat. No. Des. 288,744 issued Mar. 17, 1987, to Jack M. Taylor; and U.S. Pat. No. Des. 365,204 issued Dec. 19, 1995, to Steve S. Chen. Uber discloses a gaming pouch for keno or the like having solid walls and multiple layers or pockets. Similarly, Taylor discloses a money pouch having solid walls. Chen discloses a neck pack organizer having solid walls and zippers.

Further examples of similar prior art include U.S. Pat. No. 735,560 issued Aug. 4, 1903, to Josephine Muller; U.S. Pat. No. 1,240,060 issued Sep. 11, 1917, to Abraham Kulick; and German Patent No. 3,300,573 issued Jul. 21, 1983, to Jose Mas Jorda. Muller discloses a flexible bag having one continuous tubular length defined by an inner and outer wall. The bag of Muller is constructed from an interwoven fabric having a closed seamless bottom and an open top. The open top is drawn tight by a drawstring with a pair of free ends. Kulick discloses a handbag having metal plates sewn into a soft pliable body made of silk, leather, or the like. Kulick's device has a pair of drawstrings which pass through the metal plates for drawing the mouth of the bag tight. At the bottom of Kulick's device hangs a tassel. Jorda discloses a mesh handbag having reinforced handles.

Unlike most bags used as articles of clothing, some bags for holding foodstuffs and other items are often made without solid walls. However, such bags are usually devoid of any decorative appeal, as function is the main concern. The function referred to is that of proper conservation of the items contained within the bag, such as aeration of foodstuffs.

Examples of the prior art relative to such holding devices include U.S. Pat. No. 1,749,776 issued Mar. 11, 1930, to L. A. O'Lena; U.S. Pat. No. 672,499 issued Apr. 23, 1901, to J. J. Tully; U.S. Pat. No. 5,031,759 issued Jul. 16, 1991, to Greg Ogilvie; U.S. Pat. No. 5,207,725 issued May 4, 1993, to Linda L. Pinkerton; and French Patent No. 1,364,048 issued May 14, 1964, to Jean and Georges Louma. O'Lena discloses a ham bag consisting of a unitary seamless knit fabric tube having a relatively tightly knit portion to enclose a ham shank, a relatively loosely knit and expandable portion to enclose the butt of the ham shank, and a cord connected to the shank for suspension of the covered ham during curing. Tully discloses a laundry bag having a rounded bottom in which strands or cords forming the bag radiate from a central ring. Tully indicates that a bag of this construction will possess unusual strength. Tully also makes a general disclosure that a drawstring may be employed to draw the bag closed. Both Ogilvie and Pinkerton disclose soap-holding bags having a sleeve with an open end and a closed end, as well as some type of closing mechanism such as a drawstring or the like. The sleeves are made from a loosely knitted polyester material in order to prevent undue deterioration of the soap contained within the bag. Louma discloses bags having large mesh holes in order to permit potatoes and other foodstuffs contained therein to aerate or breathe.

None of the above inventions and patents, taken either singularly or in combination, is seen to describe the instant invention as claimed. Thus a mesh bag solving the aforementioned problems is desired.

SUMMARY OF THE INVENTION

The present invention is a holding device including a mesh bag having an open end and an opposite closed end defining an interior. A drawstring having a draw bead or knot may be used to close the open end of the bag once a user has placed objects within its interior. A decorative tassel may depend from the bottom of the bag proximate the closed end. The closed end of the bag may be formed by gluing, crimping, or knotting the material forming the bag. The drawstring ends may be tied into a knot or be fitted into a safety brake for ameliorating the possibility of strangulation.

The material forming the bag may be cotton, nylon, polyester, rayon, leather, metal, and/or wood of any color. The mesh characteristics of the bag may be formed by weaving, fusing, or knotting this material. In one embodiment, the mesh container is a plurality of dual strands interwoven and tied into a series of knots to form a diamond-shape weave. The interstices forming the mesh range from a few millimeters to a few centimeters in width. The actual length of the mesh bag may be from 3 to 24 centimeters depending on how and where the user desires to hang the bag about the body.

The material forming the drawstring may be heavy or light string having a length from approximately 25 to 75 centimeters. The optional draw bead and crimp bead used to close the open end and closed end of the bag, respectively, may be made of metal, plastic, or wood of varying size and color.

In use, the wearer may insert small items into the open end of the bag for convenient carriage thereof. These items may include cash or change; keys; credit cards; fishing, hunting, or driver's license; medications such as aerosols for asthma patients; toiletries such as lipstick, chapstick, etc.; and passes such as a ski lift passes, etc. The bead or the like is then used in conjunction with the drawstring to easily and quickly open and close the open end of the bag, even while the bag depends from the body.

The mesh bag may be worn under a shirt or trousers in order to prevent theft or loss of valuables. Alternatively, due to the decorative aspect of the bag, the user may choose to safely wear the mesh bag to adorn the outside of the shirt. The mesh design of the bag particularly allows for the user to conveniently and safely carry valuables at the beach, even while swimming, without any increase in weight of the holding device due to water. Any potential for strangulation is advantageously ameliorated due to the optional safety brake.

Accordingly, it is a principal object of the invention to allow a user to keep money and other valuables safe from loss or theft while conveniently carrying the valuables on the body.

It is another object of the invention to provide a lightweight holding device capable of being adorned by a user comfortably.

It is a further object of the invention to provide a functional holding device in addition to a decorative article of clothing.

Still another object of the invention is to provide a holding device which can be quickly and easily opened and closed.

It is another object of the invention to create a holding device which does not retain water, thus allowing the user to keep valuables on the body, rather than on the beach, while swimming.

It is another object of the invention to provide improved elements and arrangements thereof in a holding device for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
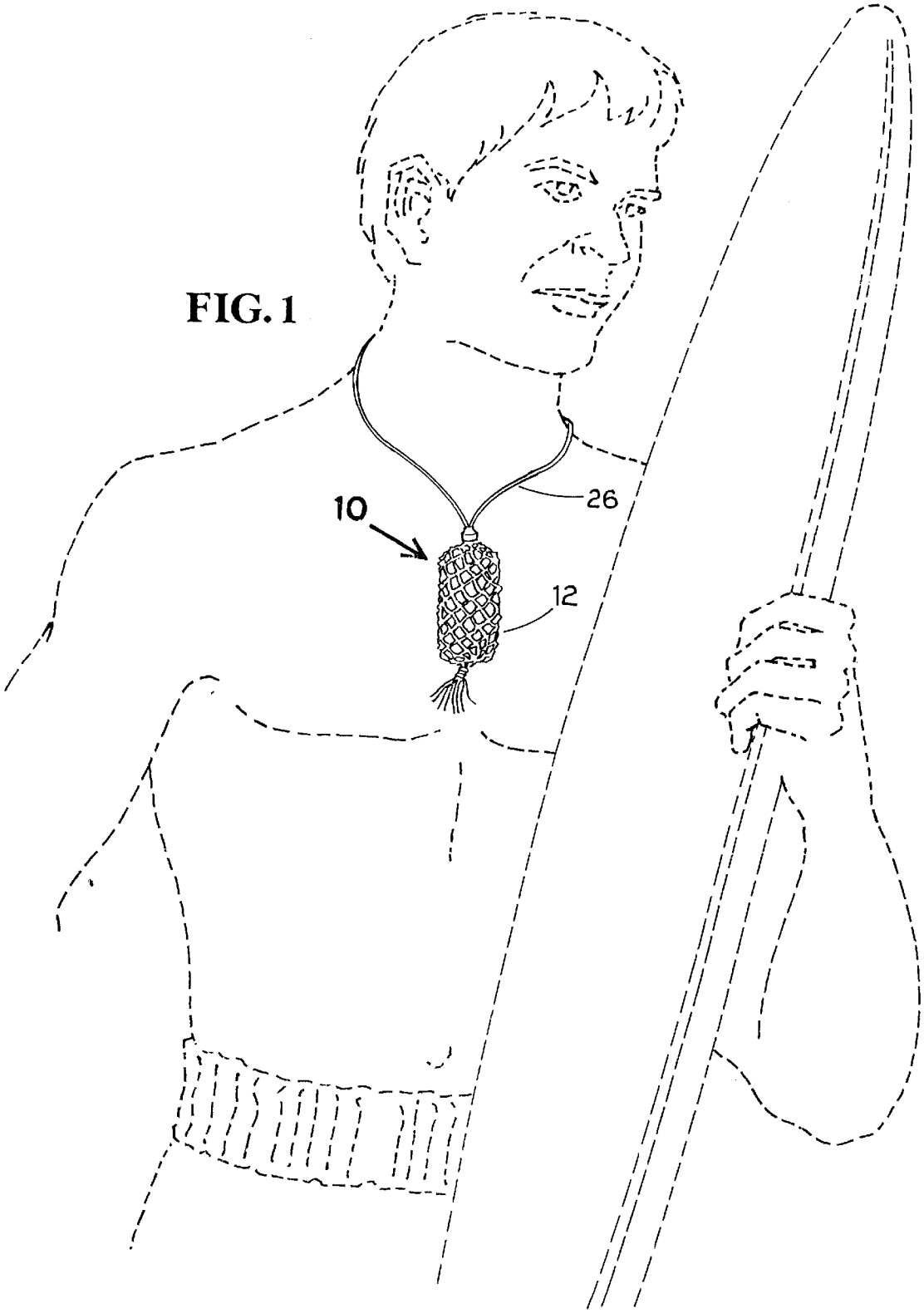
FIG. 1 is an environmental, perspective view of a mesh bag according to one embodiment of the present invention.
Figure 3:
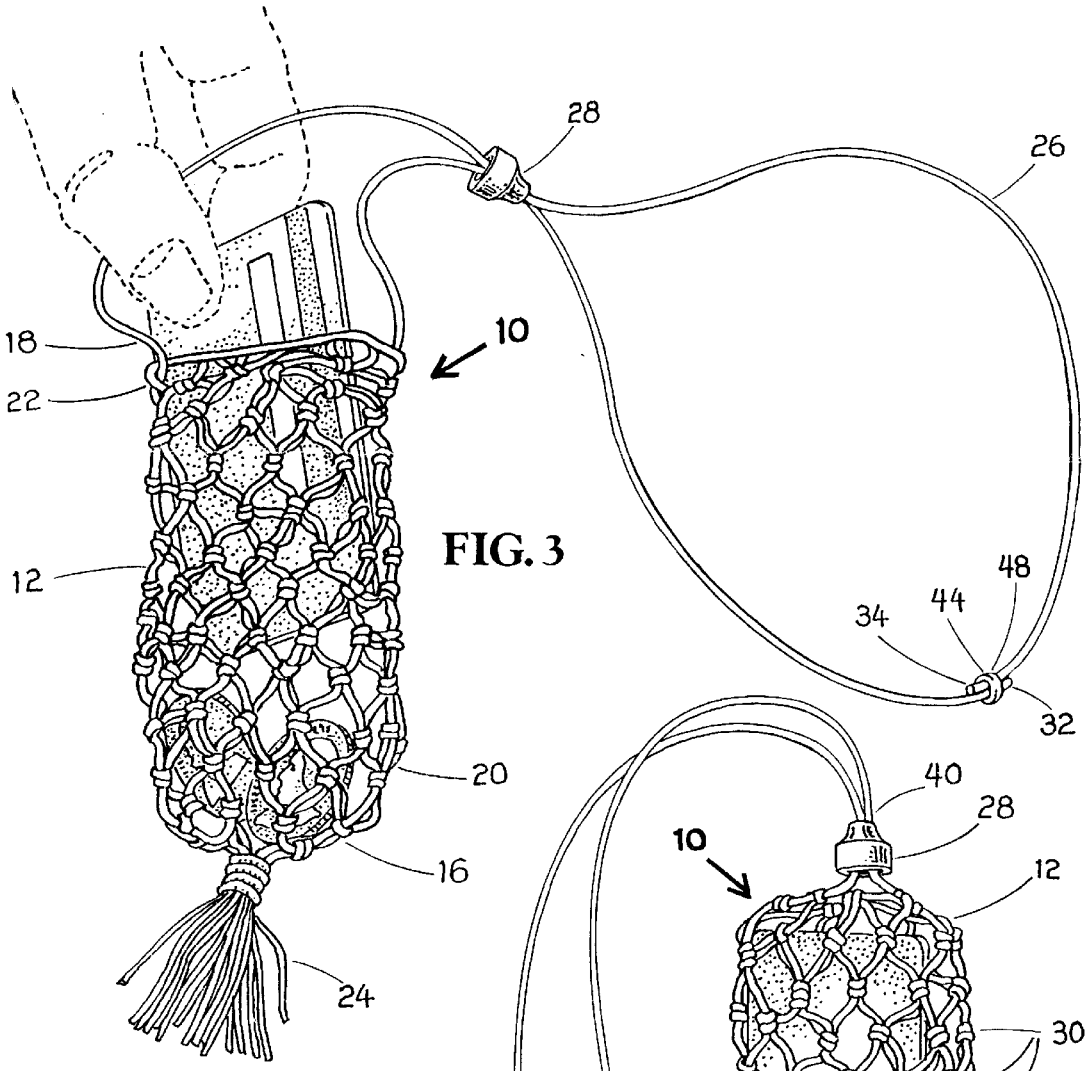
FIG. 3 is an environmental, perspective view of a mesh bag according to another embodiment of the present invention in which the open end of the mesh bag is opened for inserting objects into or retrieving objects from the bag's interior.
Figure 2:
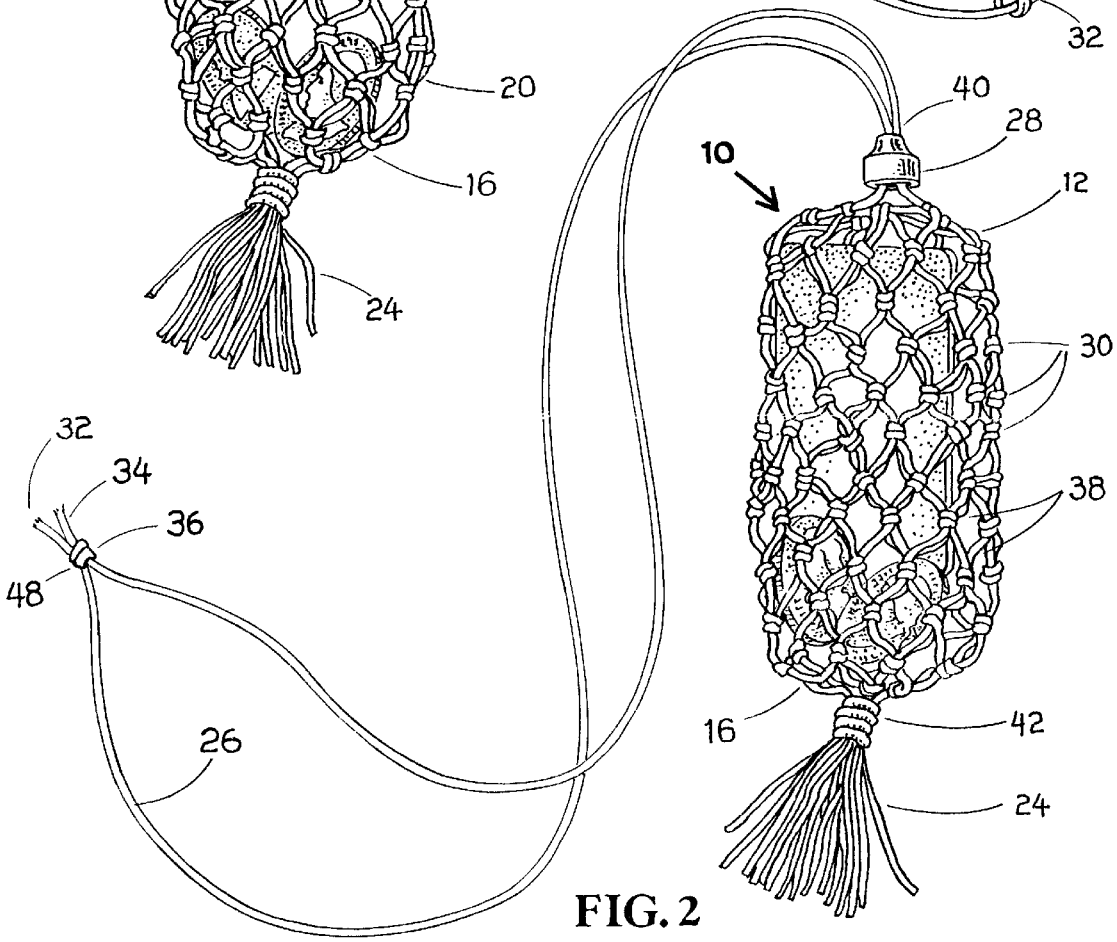
FIG. 2 is a perspective view of the mesh bag as seen in FIG. 1 in which the open end of the mesh bag is closed for carrying purposes.

Referring to FIG. 1, a holding device 10 according to the present invention is shown adorning a user. As best seen in FIGS. 2–3, the holding device 10 includes a mesh container 12 having an interior 14 defined by a closed end 16 and an open end 18. The closed end 16 is located proximate the bottom portion 20 of container 12. The open end 18 is located proximate the top portion 22 of container 12.. The closed end 16 may be formed by gluing, crimping, or knotting the material forming container 12.

An optional tassel 24 and knot 42 can be seen hanging from the bottom portion 20 of container 12. In place of knot 42, a crimp bead (not shown) may be used. A drawstring 26 having opposing ends 32, 34 in conjunction with a cinching mechanism 28 interacts with the top portion 22 of container 12 for opening and closing the open end 18 of container 12. Means for securing 48 drawstring ends 32, 34 together include a knot 36 or a safety brake 44 for ameliorating the possibility of strangulation. As shown in FIG. 3, safety brake 44 is a ring loosely clamped around drawstring ends 32, 34. The ring may be made of metal or plastic. Too much force on drawstring ends 32, 34 will cause them to dislodge from safety brake 44, thereby minimizing the risk of strangulation and promoting safety.

The material forming container 12 bag may be cotton, nylon, polyester, rayon, leather, metal, and/or wood of any color. The mesh characteristics of container 12 may be formed by weaving, fusing, or knotting this material. The holes forming the mesh can range from a few millimeters to a few centimeters in width. The actual length of container 12 may be from 3 to 24 centimeters, depending on how and where the user desires to hang holding device 10 about the body. Container 12 may be approximately 1 to 8 centimeters in width.

The material forming drawstring 26 may be heavy or light string having a length from approximately 25 to 75 centimeters. Cinching mechanism 28 can be a draw bead (shown in FIG. 2) or a running knot made of fine strand loosely wound about drawstring 26. The optional draw bead and crimp bead used to close the open end and closed end of the bag, respectively, may be made of metal, plastic, or wood, each of varying sizes and colors.

As seen in FIGS. 1–3, container 12 of the holding device 10 is constructed using strands made of cotton, nylon, polyester, or mixtures thereof. Container 12 is formed by lining up a plurality of dual strands end-to-end, braiding together each dual strand starting approximately 5 centimeters from one end of the dual strands, and tieing each braided section together to form a series of interlocking knots 30 such that a diamond-shape weave appears.

This pattern of braiding and tieing is continued until a woven cylindrical container 12 approximately 8 centimeters in length and approximately 3 centimeters in diameter is produced. The 5 centimeter portion of strands not constituting container 12 is wrapped about itself to form tassel 24 approximately 3 centimeters long. It is clear that with this mode of construction, tassel 24 will always be of the same material as container 12. It should also be clear that tassel 24 functions to define the closed end 16 of container 12, as well as to add a decorative attribute.

After container 12 is produced, drawstring 26 is then inserted through the interstices 38 of the mesh at the top portion 22 of container 12. Once this interaction has been effected with the top portion 22 of container 12, drawstring 26 may then be inserted through the passage 40 of cinching mechanism 28 and its opposing ends 32, 34 tied off into knot 36 (as seen in FIG. 2.). Alternatively, drawstring 26 may be inserted through interstices 38 of the mesh at the top portion 22 of container 12, inserted into safety brake 44, and then grasped by cinching mechanism 28 (as seen in FIG. 3).

In operation, a user draws cinching mechanism 28 away from the top portion 22 of container 12 in order to define a large enough opening for inserting items into interior 14, as best seen in FIG. 3. These items may include cash or change; keys; credit cards; fishing, hunting, or driver's license; medications such as aerosols for asthma patients; toiletries such as lipstick, chapstick, etc.; and passes such as a ski lift passes, etc. As seen in FIG. 3, the user is inserting a credit card into container 12. Referring to FIG. 2, the user has chosen to insert a key, change, and a one-dollar bill.

After insertion, the user will then contain the items within interior 14 by pulling cinching mechanism 28 back down toward the top portion 22 of container 12. In this manner, the open end 18 of container 12 is in a closed position, as best seen in FIG. 2. If the user has not already done so at this point in time, the user may optionally place holding device 10 around the neck or waist for safekeeping. Due to the decorative aspect of holding device 10, the user may choose to wear it outside of the shirt.

Advantageously, the mesh design of holding device 10 allows the user to conveniently and safely carry valuables at the beach, even while swimming, without any increase in weight of the holding device due to water. Any potential for strangulation is advantageously ameliorated due to the optional safety brake.

It is to be understood that the present invention is not limited to the embodiments described above, but encompasses any and all embodiments within the scope of the following claims.

I claim:

1. A holding device for receiving various types of articles therein, a portion of the device adapted for receipt around a neck of a user of the holding device, the holding device comprising:

a mesh container with interior, said mesh container having a closed end and an opposing open end;

a drawstring inserted through said mesh container next to said open end, said drawstring having a first end and a second end, a portion of said first end and said second end adapted for receipt around the neck of the user;

a cinching mechanism slidably engaging said drawstring for closing the open end of said mesh container and retaining items placed within the interior of said mesh container; and a safety brake ring for securing together said first end and said second end of said drawstring, said safety brake ring adapted for releasing the first end from the second end to prevent potential strangulation of the user when the first end and the second end are received around the neck of the user.

2. The holding device as described in claim 1 wherein said safety brake ring is loosely received around said first end and said second end of said drawstring.

3. The holding device as defined in claim 1 wherein said cinching mechanism is a running knot made of finely wrapped strand wrapped about said drawstring.

4. The holding device as defined in claim 1 wherein said mesh container is a plurality of dual strands braided together and tied into a series of knots defining a diamond-shape weave.

5. The holding device as defined in claim 1, further including a tassel depending from said closed end of said mesh container.

6. The holding device as defined in claim 5, further including a knot disposed between said tassel and said closed end of said mesh container.

7. The holding device as defined in claim 5 wherein said tassel is approximately 3 centimeters in length.

8. The holding device as defined in claim 1, wherein said mesh container includes interstices ranging from a few millimeters to a few centimeters in width.

9. The holding device as defined in claim 1 wherein said mesh container ranges from 3 to 25 centimeters in length and from 1 to 8 centimeters in width.

10. The holding device as defined in claim 1 wherein said drawstring is approximately 25 to 75 centimeters in length.

11. A holding device for receiving various types of articles therein, a portion of the device adapted for receipt around a neck of a user of the holding device, the holding device comprising:

a mesh container with interior, said mesh container having a closed end and an opposing open end;

a drawstring inserted through said mesh container next to said open end, said drawstring having a first end and a second end, said drawstring having a length in a range of 25 to 75 centimeters with a portion the length adapted for receipt around the neck of the user;

a cinching mechanism slidably engaging said drawstring for closing the open end of said mesh container and retaining items placed within the interior of said mesh container; and a safety brake ring for securing together the first end and the second end of said drawstring, said safety brake ring adapted for releasing the first end from the second end to prevent potential strangulation of the user when the first end and the second end are received around the neck of the user.

12. The holding device as described in claim 11 wherein said cinching mechanism is a draw bead having a passage for inserting said drawstring therethrough.

13. The holding device as described in claim 11 wherein said cinching mechanism is a running knot made of finely wrapped strand wrapped around said drawstring.

14. The holding device as described in claim 11 wherein said mesh container is a plurality of dual strands braided together and tied into a series of knots defining a diamond-shape weave.

15. A holding device for receiving various types of articles therein, a portion of the device adapted for receipt around a neck of a user of the holding device, the holding device comprising:

a mesh container with interior, said mesh container having a closed end and an opposing open end, said mesh container having a plurality of dual strands braided together and tied into a series of knots defining a diamond-shape weave, the diamond-shape weave forming interstices in a range of a few millimeters to a few centimeters in width, said mesh container in a range of 3 to 25 centimeters in length and in a range of 1 to 8 centimeters in width;

a drawstring inserted through said mesh container next to said open end, said drawstring having a first end and a second end, said drawstring having a length in a range of 25 to 75 centimeters with a portion the length adapted for receipt around the neck of the user;

a draw bead slidably engaging said drawstring for closing the open end of said mesh container and retaining items placed within the interior of said mesh container; and a safety brake ring for securing together the first end and the second end of said drawstring, said safety brake ring adapted for releasing the first end from the second end to prevent potential strangulation of the user when the first end and the second end are received around the neck of the user.

* * * * *